US010046328B2

(12) United States Patent
Nakayama et al.

(10) Patent No.: US 10,046,328 B2
(45) Date of Patent: Aug. 14, 2018

(54) JAW CRUSHER DRIVING DEVICE

(71) Applicant: NAKAYAMA IRON WORKS, LTD., Takeo-shi, Saga (JP)

(72) Inventors: Hiroshi Nakayama, Takeo (JP); Hideki Tominaga, Takeo (JP)

(73) Assignee: NAKAYAMA IRON WORKS, LTD., Takeo-shi (JP)

( * ) Notice: Subject to any disclaimer, the term of this patent is extended or adjusted under 35 U.S.C. 154(b) by 743 days.

(21) Appl. No.: 14/630,103

(22) Filed: Feb. 24, 2015

(65) Prior Publication Data

US 2015/0238970 A1 Aug. 27, 2015

(30) Foreign Application Priority Data

Feb. 25, 2014 (JP) ..... 2014-34654

(51) Int. Cl.
*B02C 1/02* (2006.01)
*B02C 1/00* (2006.01)
*B02C 1/04* (2006.01)

(52) U.S. Cl.
CPC ..... *B02C 1/02* (2013.01); *B02C 1/005* (2013.01); *B02C 1/04* (2013.01)

(58) Field of Classification Search
CPC .. B02C 1/02; B02C 1/005; B02C 1/04; B02C 1/025; B02C 1/043; B02C 1/046; B02C 1/06; B02C 1/10
(Continued)

(56) References Cited

U.S. PATENT DOCUMENTS 2,380,419 A * 7/1945 Ebersol ..... B02C 17/06 241/156
3,473,744 A * 10/1969 Dediemar ..... B02C 1/025 241/219

(Continued)

FOREIGN PATENT DOCUMENTS

JP 2008-279314 A 11/2008
JP 2010-64008 A 3/2010
JP 2010-82595 A 4/2010

OTHER PUBLICATIONS

English Translation of JP2010082595A English Description (Nakayama).*
English Translation of JP2010064008 English Description (Ueda).*

*Primary Examiner* — Shelley Self
*Assistant Examiner* — Maleshia Jones
(74) *Attorney, Agent, or Firm* — Westerman, Hattori, Daniels & Adrian, LLP

(57) ABSTRACT

Provided is a jaw crusher driving device in which a driving torque can be transmitted reliably to a rotation driving shaft to perform a crushing operation by strongly fixing a hydraulic pressure motor between a body frame of a jaw crusher and a flywheel. The jaw crusher includes a fixed tooth, a movable tooth, a rotation driving shaft rotatably supported on a body frame, and a pair of flywheels provided in the rotation driving shaft. The driving device includes: a hydraulic pressure motor in which a rotation shaft portion can rotate in relation to a motor body when pressure fluid is supplied; a connector for connecting one flywheel of the pair of flywheels and the rotation shaft portion; and a torque arm provided between the body frame and the motor body so as to prevent the motor body from rotating about an axis of the rotation driving shaft.

11 Claims, 4 Drawing Sheets

(58) Field of Classification Search
USPC ..... 241/264, 35, 36
See application file for complete search history.

(56) References Cited

U.S. PATENT DOCUMENTS

| | | | | | |
|---|---|---|---|---|---|
| 4,398,674 | A * | 8/1983 | Dremann | B02C 1/025 | 241/264 |
| 5,725,166 | A * | 3/1998 | Nakayama | B02C 1/025 | 241/259.1 |
| 6,915,972 | B2 * | 7/2005 | Rossi, Jr. | B02C 1/02 | 241/101.72 |
| 2004/0044458 | A1 * | 3/2004 | Kadota | B60K 6/44 | 701/55 |
| 2009/0095833 | A1 * | 4/2009 | Nakayama | B02C 1/025 | 241/264 |
| 2012/0018558 | A1 * | 1/2012 | Gervais | B02C 1/04 | 241/101.74 |
| 2012/0199680 | A1 * | 8/2012 | Ueda | B02C 1/04 | 241/267 |

* cited by examiner

JAW CRUSHER DRIVING DEVICE

BACKGROUND OF THE INVENTION

1. Field of the Invention

The present invention relates to a driving device for a jaw crusher that crushes a raw material of an object to be crushed. More specifically, the present invention relates to a jaw crusher driving device in which a hydraulic pressure motor is strongly fixed between a body frame of the jaw crusher and a flywheel to simplify the structure of the driving device and transmit a large driving torque reliably to a rotation driving shaft to perform a crushing operation.

2. Description of the Related Art

Conventionally, a jaw crusher (crusher) that compresses and crushes a raw material by allowing a swinging movable tooth to move closer to and away from a fixed tooth is known. In general, a jaw crusher performs a crushing operation by allowing a driving motor (for example, an electric motor or a hydraulic motor) to transmit a driving force to a driving shaft in which an eccentric shaft portion is formed and allowing a movable tooth to swing in relation to a fixed tooth. In this a field, a technique related to a crushing device including a driving motor-side driving pulley, a driving shaft-side driven pulley, an endless belt wound around the driving pulley and the driven pulley, a tension adjuster for the endless belt and the like is known (for example, see Japanese Patent Application Publication No. 2008-279314). Moreover, a technique related to a bucket jaw crusher in which a spline shaft of a hydraulic motor engages with a spline hole of a main eccentric shaft to allow the main eccentric shaft to rotate is known (for example, see Japanese Patent Application Publication No. 2010-064008).

On the other hand, the present applicant has proposed a technique related to a driving device for industrial apparatuses, in which an electric motor and a hydraulic motor are connected to a driving shaft (see Japanese Patent Application Publication No. 2010-082595).

SUMMARY OF THE INVENTION

In the field of such a jaw crusher, it is desirable to transmit a driving torque of a driving motor efficiently to a rotation driving shaft in order to improve crushing performance. However, the technique disclosed in Japanese Patent Application Publication No. 2008-279314 has a problem in that a slip may be formed between a belt and a pulley in case of overload or the like and a driving torque required for a crushing operation may not be transmitted. Moreover, the technique disclosed in Japanese Patent Application Publication No. 2010-064008 has a problem in that since the flywheel is provided on only one side of driving shaft, the inertial force is small and crushing performance may decrease. Further, the technique disclosed in Japanese Patent Application Publication No. 2010-082595 still has a room for improvement in the structure for transmitting a large driving torque required for the crushing operation efficiently.

The present invention has been made to solve the conventional problems and to attain the following object.

An object of the present invention is to provide a jaw crusher driving device capable of transmitting a large torque and simplifying the structure of the driving device by strongly supporting a motor body and a rotation shaft portion of a hydraulic pressure motor of the jaw crusher to a body frame and a flywheel of the jaw crusher.

The object of the present invention is attained by the following means.

According to a first aspect of the present invention, there is provided a driving device for a jaw crusher including: a fixed tooth provided in a body frame of the jaw crusher; a movable tooth provided so as to swing in relation to the fixed tooth; a rotation driving shaft which is rotatably supported on a pair of bearing portions provided in the body frame and in which an eccentric shaft portion for allowing the movable tooth to perform a swing operation is formed; and a pair of flywheels provided in shaft portions which are provided at both ends of the rotation driving shaft and protrude from the pair of bearing portions, so as to increase inertial force of the rotation driving shaft, the driving device including: a hydraulic pressure motor in which a rotation shaft portion can rotate in relation to a motor body when pressure fluid is supplied; a connector provided between the rotation shaft portion of the hydraulic pressure motor and one flywheel positioned on one side of the pair of flywheels, so as to connect the flywheel and the rotation shaft portion of the hydraulic pressure motor; and a torque arm provided between the body frame and the motor body of the hydraulic pressure motor, so as to prevent the motor body from rotating about an axis of the rotation driving shaft when the rotation shaft portion of the hydraulic pressure motor rotates.

A jaw crusher driving device according to a second aspect is the jaw crusher driving device according to the first aspect in which the connector includes a first connection member detachably fixed to an end surface of the flywheel, and a second connection member detachably fixed to an end surface of the rotation shaft portion of the hydraulic pressure motor, the first connection member and the second connection member being fastened and fixed together by a fastening member.

A jaw crusher driving device according to a third aspect is the jaw crusher driving device according to the first aspect in which the torque arm is formed of: a torque arm support positioned on a lower side of the flywheel and provided on a side surface of the body frame so as to protrude in a direction parallel to the axial direction of the rotation driving shaft; and a torque arm member, one side of which is fixed to the torque arm support and the other side of which is fixed to the motor body of the hydraulic pressure motor, the torque arm member preventing the motor body from rotating about the axis of the rotation driving shaft.

A jaw crusher driving device according to a fourth aspect is the jaw crusher driving device according to the third aspect in which the torque arm member has a portion on the one side, which is detachably fixed to the torque arm support.

A jaw crusher driving device according to a fifth aspect is the jaw crusher driving device according to the fourth aspect in which the torque arm member has a portion on the other side, which is formed in a ring shape so as to form a pipe and a joint for supplying the pressure fluid to the hydraulic pressure motor.

A jaw crusher driving device according to a sixth aspect is the jaw crusher driving device according to the fourth aspect in which the torque arm member and the torque arm support are formed in a bilaterally symmetrical shape in a plane orthogonal to the axis of the rotation driving shaft.

A jaw crusher driving device according to a seventh aspect is the jaw crusher driving device according to the first to sixth aspects in which the other flywheel positioned on the other side of the pair of flywheels receives rotation driving force of an electric motor provided in the body frame via a driving force transmission mechanism.

A jaw crusher driving device according to an eighth aspect is the jaw crusher driving device according to the seventh aspect in which the electric motor is used during a normal operation mode and the hydraulic pressure motor is used during start-up or for eliminating troubles.

In the jaw crusher driving device according to the aspects of the present invention, the motor body and the rotation shaft portion of the hydraulic pressure motor are strongly mounted to the body frame of the jaw crusher and one of the pair of flywheels, and a driving torque required for a crushing operation is reliably transmitted. Moreover, the hydraulic pressure motor has a configuration in which an end surface of the rotation shaft portion is connected to an end surface of the flywheel by a connection member at a position with a pitch circle diameter larger than the diameter of the rotation driving shaft. Moreover, the torque arm is fixed to the body frame side at a position corresponding to a radius larger than the radius of the pair of flywheels so as to stop the rotation of the motor body of the hydraulic pressure motor. With these configurations, a large driving torque can be transmitted from the hydraulic pressure motor to the rotation driving shaft.

The torque arm is formed of a torque arm support and a torque arm member, an engagement convex portion formed in the torque arm member engages with an engagement concave portion of the torque arm support, and the torque arm support and the torque arm member are fixed by bolts or the like. With these configurations, it is possible to provide an excellent rotation prevention effect.

The torque arm member and the torque arm support are formed bilaterally symmetrical in a plane orthogonal to the axis of the rotation driving shaft, and a large driving torque can be transmitted whether the rotation shaft portion of the hydraulic pressure motor rotates in a normal rotation direction or a reverse direction.

Moreover, since the jaw crusher driving device can be attached from an outer side of the body frame of the jaw crusher, the jaw crusher driving device can be attached afterwards to an electric motor-type jaw crusher, and it is easy to perform maintenance.

Further, the jaw crusher in which the jaw crusher driving device is provided uses the electric motor driving portion in a normal operation mode and uses the hydraulic pressure motor driving portion during start-up or for eliminating troubles. Thus, it is possible to utilize each the excellent characteristics of the electric motor and the hydraulic pressure motor and to perform the crushing operation efficiently.

DESCRIPTION OF THE PREFERRED EMBODIMENTS

Hereinafter, an embodiment of a jaw crusher driving device 1 according to the present invention will be described with reference to the drawings.

Figure 1:
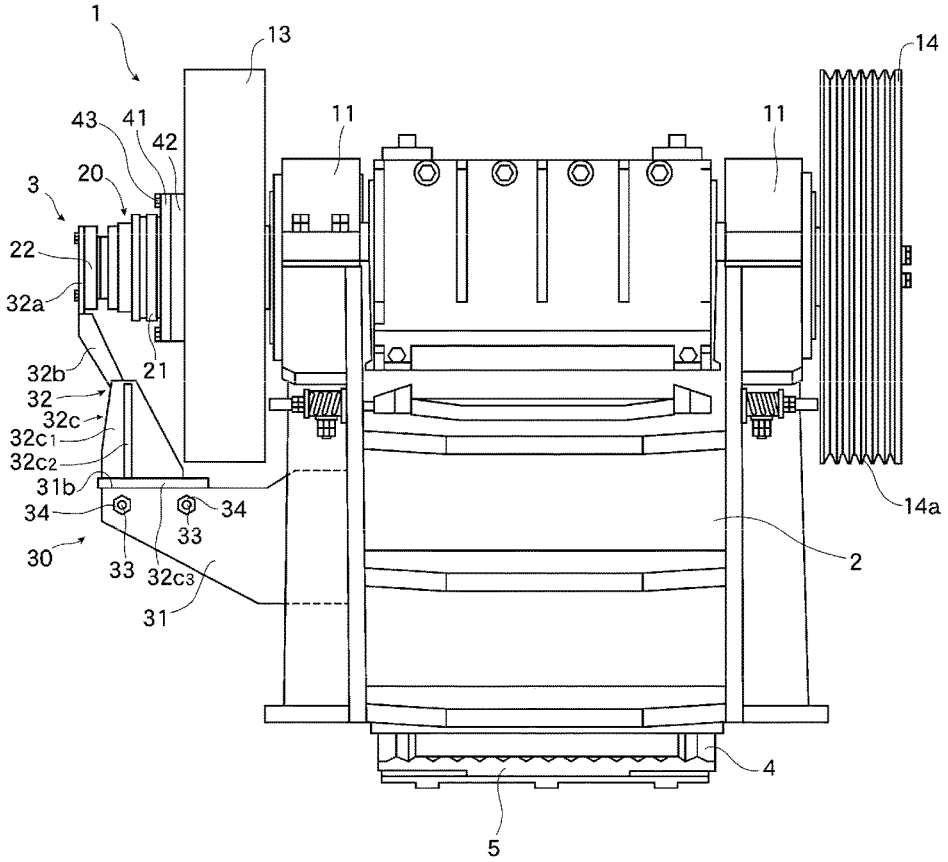
FIG. 1 is a front view illustrating a jaw crusher in which a jaw crusher driving device according to the present invention is provided.
Figure 2:
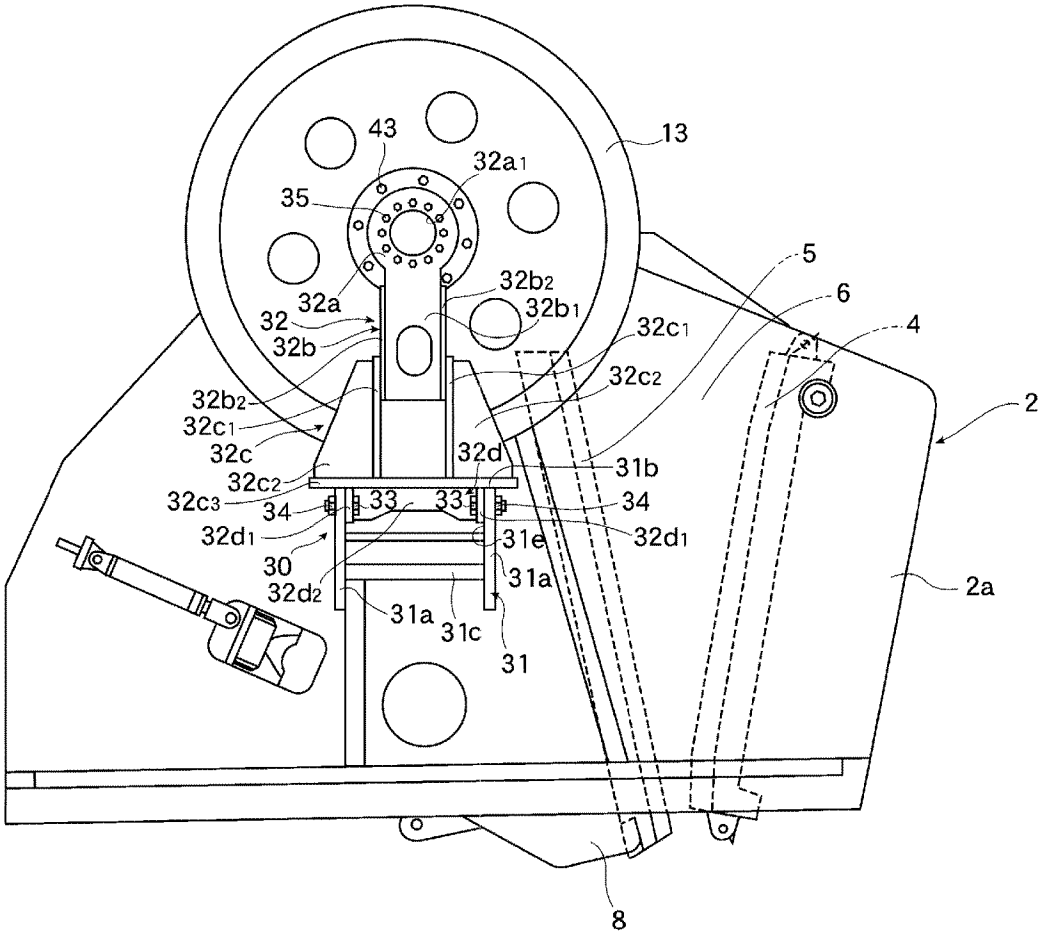
FIG. 2 is a side view illustrating the jaw crusher in which the jaw crusher driving device according to the present invention is provided.
Figure 3:
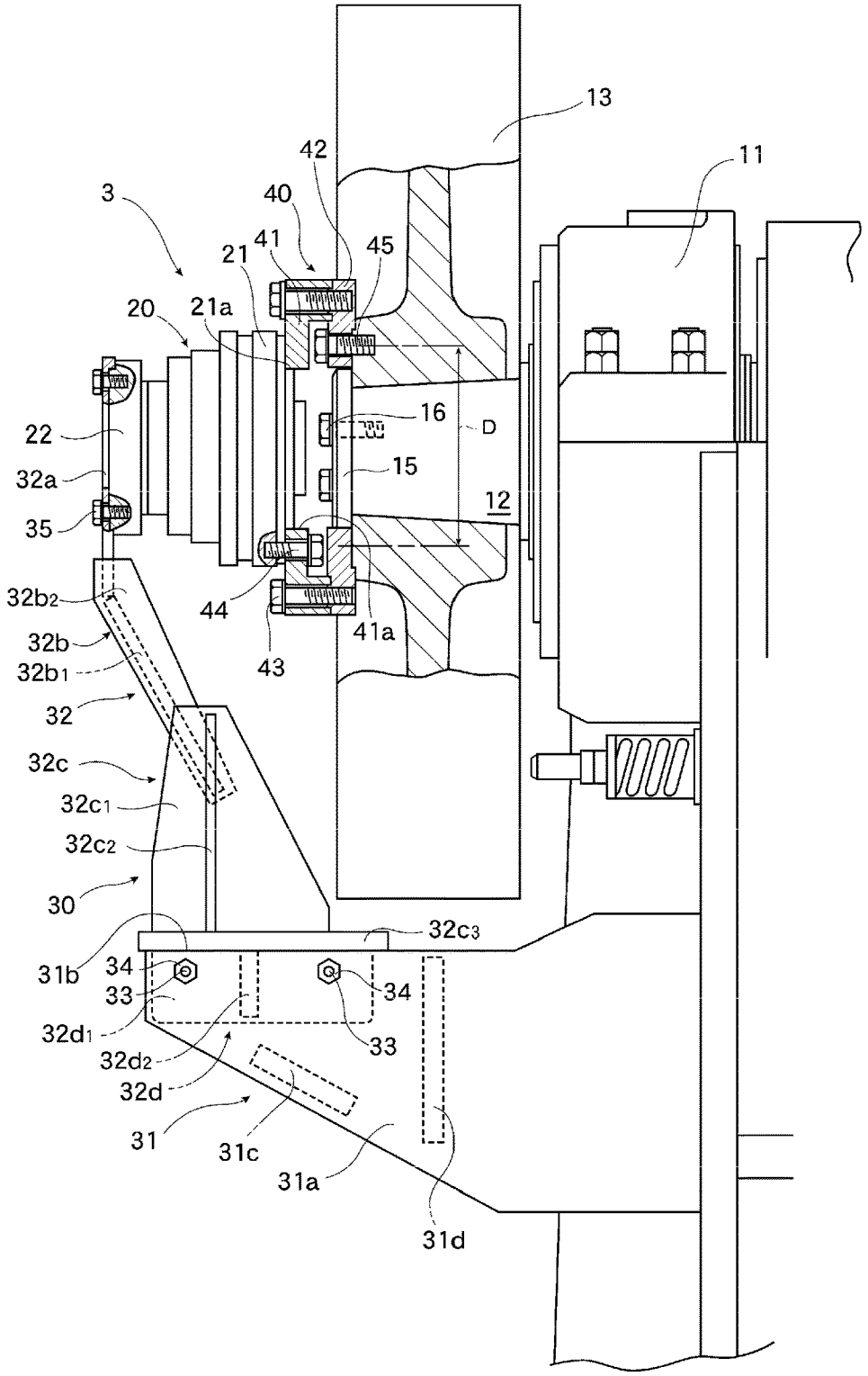
FIG. 3 is a front view illustrating portions of the jaw crusher driving device according to the present invention in cross-sections.
Figure 4:
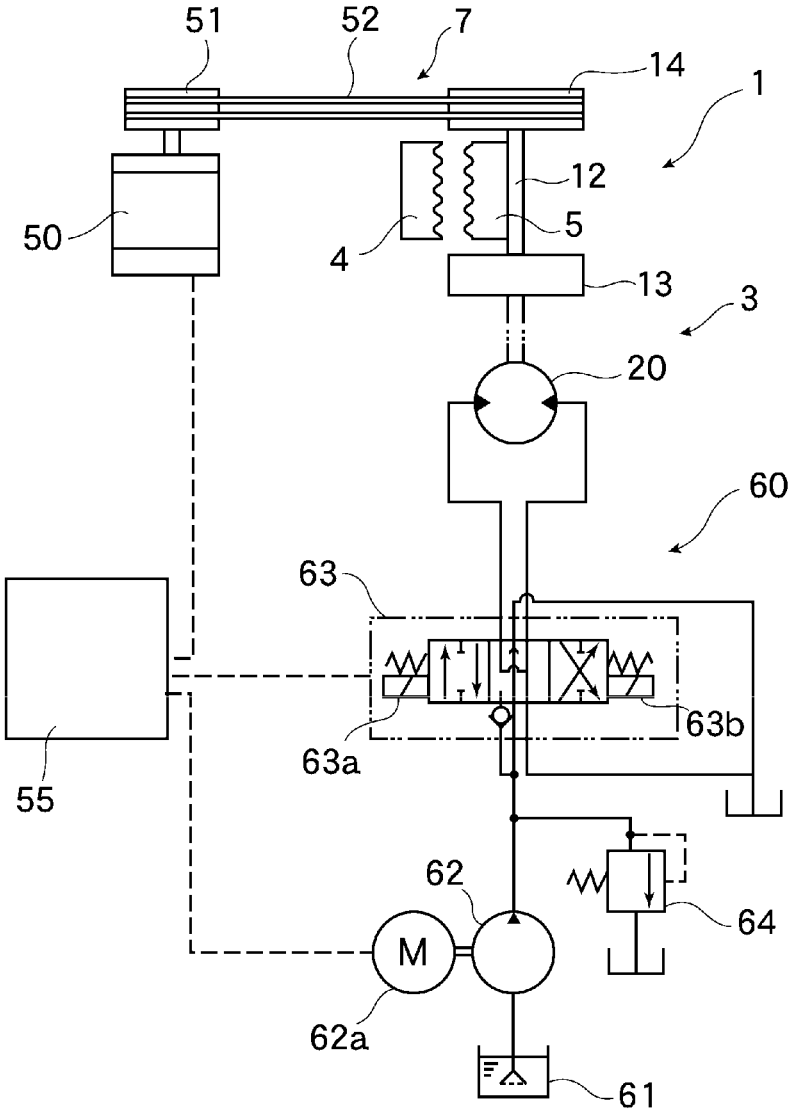
FIG. 4 is a schematic view illustrating the configuration of main parts of the jaw crusher driving device according to the present invention.

FIG. 1 is a front view illustrating a jaw crusher in which a jaw crusher driving device according to the present invention is provided, and FIG. 2 is a side view illustrating the jaw crusher in which the jaw crusher driving device is provided. FIG. 3 is a front view illustrating portions of the jaw crusher driving device in cross-sections. FIG. 4 is a schematic view illustrating the configuration of main parts of the jaw crusher driving device.

A basic configuration of the jaw crusher 2 in which the jaw crusher driving device 1 according to the present embodiment is provided is known in the art. Thus, detailed description of the structure of the jaw crusher 2 will not be provided, but an outline thereof will be described in order to facilitate the understanding of the present embodiment.

The jaw crusher 2 has a fixed tooth 4 which is fixed at a predetermined position of a body frame 2*a*. Two bearing portions 11 which are located axially, are fixed to the body frame 2*a*, and a rotation driving shaft 12 (see FIG. 3) is rotatably supported on the bearing portions 11. An eccentric shaft portion for allowing a swing jaw 8 to swing about a toggle plate (not illustrated) provided on a lower side of the swing jaw 8 is formed in a central portion of the rotation driving shaft 12. A movable tooth 5 is fixed to the swing jaw 8. A space between the fixed tooth 4 and the movable tooth 5 forms a crushing chamber 6. The rotation driving shaft 12 includes a pair of flywheels (one is 13 and the other is 14) which is provided in portions of the rotation driving shaft 12 protruding from the bearing portions 11 (shaft portions at both ends of the rotation driving shaft 12). The flywheel 13 and the other flywheel 14 are configured to increase inertial force so that a variation in the load of the rotation driving shaft 12 during a crushing operation decreases. The flywheel 13 has an inner circumferential portion inserted into a wheel shaft portion of the rotation driving shaft 12. Moreover, the flywheel 13 is fixed to the rotation driving shaft 12 in an axial direction of the rotation driving shaft 12. That is, a pressing member 15 for pressing an end surface of the flywheel 13 is fixed to an end surface of the rotation driving shaft 12 by a bolt 16 whereby the flywheel 13 is fixed by being pressed in the axial direction of the rotation driving shaft 12. The flywheel 13 and the rotation driving shaft 12 are coupled by a key (not illustrated).

The jaw crusher 2 is a crusher which is driven by a driving device having two types of driving portions, namely, a hydraulic pressure motor driving portion 3 and an electric motor driving portion 7 and which can perform a crushing operation. For example, when a crushing operation starts, the hydraulic pressure motor driving portion 3 rotates the rotation driving shaft 12. When the rotation speed of the rotation driving shaft 12 reaches a predetermined rotation speed, the driving of the hydraulic pressure motor driving portion 3 stops and the electric motor driving portion 7 rotates the rotation driving shaft 12. In other words, the electric motor driving portion 7 is used in a normal operation mode, and the hydraulic pressure motor driving portion 3 is used at the start-up or for eliminating troubles. In the jaw crusher 2, a large driving torque may be required during start-up of the crushing operation or for eliminating troubles. In the jaw crusher driving device 1 of the present embodiment, the hydraulic pressure motor driving portion 3 is provided so as to enable a large driving torque to be transmitted. The jaw crusher driving device 1 may include at least the hydraulic pressure motor driving portion 3 and may include the hydraulic pressure motor driving portion 3 and the electric motor driving portion 7.

A driven pulley groove 14*a* is formed in an outer circumference of the other flywheel 14. An electric motor 50 (see FIG. 4) of the electric motor driving portion 7 is provided in the body frame 2*a*. A driving pulley 51 is fixed to an output shaft of the electric motor 50. An endless belt (for example, a V-belt) 52 is wound between the pulley groove of the driving pulley 51 and the driven pulley groove 14*a* formed in the flywheel 14. When the electric motor 50 of the electric motor driving portion 7 is driven by a controller 55, a driving torque of the electric motor 50 is transmitted to the rotation driving shaft 12 via a belt transmission mechanism (driving force transmission mechanism) made up of the driving pulley 51, the belt 52, the driven pulley groove 14*a*, and the like, whereby the rotation driving shaft 12 rotates. With rotation of the eccentric shaft portion of the rotation driving shaft 12, the movable tooth 5 moves closer to and away from the fixed tooth 4 whereby a crushing operation is performed. The controller 55 controls the rotation of the electric motor 50 with the aid of an electric motor control unit included therein. The driving force transmission mechanism may be other types of transmission mechanisms as long as the mechanism can transmit the rotation driving force of an electric motor to the other flywheel and the rotation driving shaft.

Moreover, the controller 55 controls hydraulic control equipment in the hydraulic pressure circuit 60 to control the rotation of a hydraulic pressure motor (for example, a hydraulic motor) 20 of the hydraulic pressure motor driving portion 3. For example, the controller 55 magnetizes and demagnetizes solenoids 63*a* and 63*b* of an electromagnetic direction switching valve 63 to control a supply direction of pressure fluid (for example, pressure oil) supplied to the hydraulic pressure motor 20 to thereby control the rotation direction of the rotation shaft portion 21. An operation fluid (for example, an operation oil) stored in an operation fluid tank (for example, an operation oil tank) 61 is pressurized to a predetermined pressure by a hydraulic pressure pump (for example, a hydraulic pump) 62 having a motor 62*a* and is supplied to the hydraulic pressure motor 20 as a pressure fluid (for example, a pressure oil). Reference numeral 64 denotes a relief valve provided in a hydraulic pressure circuit (for example, a hydraulic circuit) 60.

The configuration of the hydraulic pressure motor driving portion 3 will be described in further detail.

The hydraulic pressure motor 20 is provided in the flywheel 13 with a connector 40 interposed. When a pressure fluid having a predetermined pressure is supplied to the hydraulic pressure motor 20, the rotation shaft portion 21 rotates in relation to a motor body 22. The hydraulic pressure motor 20 can change the rotation direction of the rotation shaft portion 21 to a normal rotation direction or reverse direction by the electromagnetic direction switching valve 63 switching the supply direction of the pressure fluid. Moreover, the hydraulic pressure motor 20 is preferably configured such that, when the supply of the pressure fluid stops, the rotation shaft portion 21 freely runs in relation to the motor body 22. With such a configuration, even when the hydraulic pressure motor 20 is directly connected to the flywheel 13, the rotation driving shaft 12 can be rotated with the rotation driving force of the electric motor 50 of the electric motor driving portion 7 and the crushing operation can be performed. Since the configuration in which the hydraulic pressure motor 20 is put into a free-run state is a known technique (for example, see U.S. Pat. No. 7,225,720 B2) and is not the gist of the present embodiment, detailed description thereof will not be provided in the present embodiment.

The connector 40 includes a second connection member 42 fixed to the flywheel 13, a first connection member 41 fixed to the rotation shaft portion 21 of the hydraulic pressure motor 20, and a fastening bolt 43 which is a fastening member that fastens and fixes the first connection member 41 and the second connection member 42 together. The second connection member 42 is detachably fixed to one end surface of the flywheel 13 by a plurality of (for example, eight) bolts 45 and washers and the like. A fitting shaft portion is formed in the flywheel 13, and the flywheel 13 is aligned when the fitting shaft portion is fitted into a fitting hole of the second connection member 42. The first connection member 41 is detachably fixed to the other end surface of the rotation shaft portion 21 by a plurality of (for example, eight) bolts 44 and washers and the like. A fitting shaft portion 21*a* is formed in the rotation shaft portion 21, and the rotation shaft portion 21 is aligned when the fitting shaft portion 21*a* is fitted into a fitting hole 41*a* of the first connection member 41. The second connection member 42 fixed to the flywheel 13 and the first connection member 41 fixed to the rotation shaft portion 21 are fastened and fixed together by a plurality of (for example, eight) fastening bolts 43 and washers and the like, which are fastening members. The first and second connection members 41 and 42 are aligned when the fitting shaft portion formed in the second connection member is fitted into the fitting hole of the first connection member 41. In this manner, when the first connection member 41 and the second connection member 42 are fastened and fixed together by the fastening bolt 43, the flywheel 13 and the rotation shaft portion 21 of the hydraulic pressure motor 20 are fixed integrally. The rotation shaft portion 21 of the hydraulic pressure motor 20 and the flywheel 13 are connected by the connector 40 in a state of being fixed by the bolt 44, the bolt 45, the fastening bolt 43, and the like at a position with a pitch circle diameter (D) larger than the diameter of the rotation driving shaft 12.

A torque arm support 31 is fixed to the body frame 2*a* at a position below the flywheel 13 by welding or the like. The torque arm support 31 includes a pair of main plate portions 31*a*, a first connecting plate portion 31*c*, and a second connecting plate portion 31*d* for connecting the pair of main plate portions 31*a* integrally, and the like. The pair of main plate portions 31*a* and the first and second connecting plate portions 31*c* and 31*d* have butting portions and bonding portions which are integrally fixed by welding. The first connecting plate portion 31*c* and the second connecting plate portion 31*d* are configured to maintain the distance between the pair of main plate portions 31*a* to be within predetermined processing accuracy and to maintain the posture of the pair of main plate portions 31*a* so that the main plate portions 31*a* are parallel to each other. The pair of main plate portions 31*a* extends in the axial direction of the rotation driving shaft 12 exceeding the length in the axial direction of the flywheel 13. An upper surface 31*b* of one of the pair of main plate portions 31*a* is a mounting surface on which a torque arm member 32 is mounted. The inner surfaces of the pair of main plate portions 31*a* form an engagement concave portion 31*e*. Bolt holes and the like for inserting bolts 33 therethrough are formed at predetermined positions of the pair of main plate portions 31*a* by mechanical processing.

The torque arm member 32 is mounted on the upper surface 31*b* of the torque arm support 31. The torque arm member 32 includes a ring-shaped motor attachment portion 32*a* provided at an upper side, an arm rotation locking portion 32*c* provided at a lower side and fixed to the torque arm support 31 so as to stop rotation of the torque arm member 32, an intermediate arm portion 32*b* provided between the motor attachment portion 32*a* and the arm rotation locking portion 32*c*, and an engagement convex portion 32*d* provided in a lower portion of the arm rotation locking portion 32*c*.

The engagement convex portion 32*d* is a portion which is removably engaged with the engagement concave portion 31*e* of the torque arm support 31 and which is integrally fixed to the pair of main plate portions 31*a* by the bolts 33, nuts 34, washers (not illustrated), and the like. The engagement convex portion 32*d* includes a pair of engagement plate portions 32*d*1 and a connecting plate portion 32*d*2 provided between the engagement plate portions 32*d*1. Bolt holes and the like for inserting the bolts 33 therethrough are formed at predetermined positions of the pair of engagement plate portions 32*d*1 of the engagement convex portion 32*d* by mechanical processing. The pair of main plate portions 31*a* of the torque arm support 31 and the pair of engagement plate portions 32*d*1 of the torque arm member 32 are detachably fixed by the bolts 33, the nuts 34, the washers, and the like.

The arm rotation locking portion 32*c* includes a pair of leg plate portions 32*c*1 erected on a supporting plate portion 32*c*3. A reinforcing plate portion 32*c*2 for reinforcing the bonding between the supporting plate portion 32*c*3 and the leg plate portion 32*c*1 is erected between the supporting plate portion 32*c*3 and the leg plate portion 32*c*1. The supporting plate portion 32*c*3, the leg plate portion 32*c*1, and the reinforcing plate portion 32*c*2 have butting portions and bonding portions which are integrally fixed by welding. The arm rotation locking portion 32*c* is a portion which stops rotation of the intermediate arm portion 32*b* fixed to the motor attachment portion 32*a* that is attached to the motor body 22 of the hydraulic pressure motor 20 and which is fixed to the torque arm support 31 with the engagement convex portion 32*d* interposed.

The motor attachment portion 32*a* is a portion for detachably fixing the motor body 22 of the hydraulic pressure motor 20 by a plurality of bolts 35 and washers and the like. A hole 32*a*1 is formed at the center of the motor attachment portion 32*a* and a fluid pressure (oil pressure) joint (not illustrated) for supplying and discharging pressure fluid (for example, pressure oil) to and from the hydraulic pressure motor 20 is threaded into the hole 32*a*1. A hose or the like is connected to the fluid pressure joint. The hole 32*a*1 and bolt holes and the like for inserting the bolts 35 therethrough are formed in the motor attachment portion 32*a* by mechanical processing.

The intermediate arm portion 32*b* is a member for connecting the motor attachment portion 32*a* and the arm rotation locking portion 32*c* with high rigidity. The intermediate arm portion 32*b* includes an intermediate plate portion 32*b*1 provided integrally to be continuous with the motor attachment portion 32*a* and side plate portions 32*b*2 provided at both ends of the intermediate plate portion 32*b*1 in order to reinforce the intermediate plate portion 32*b*1. The intermediate plate portion 32*b*1 and the side plate portions 32*b*2 have butting portions and bonding portions which are integrally fixed by welding. The motor attachment portion 32*a* and the intermediate arm portion 32*b* have butting portions, bonding portions, and the like which are integrated by welding, bolt-coupling, and the like. The arm rotation locking portion 32*c* and the intermediate arm portion 32*b* have butting portions, bonding portions, and the like which are integrated by welding, bolt-coupling, and the like. The torque arm member 32 is a high-rigidity member of which the respective plate portions are formed of a plate material such as rolled steel (for example, SS400) for general structural applications. The torque arm member 32 is a high-rigidity member of which the respective plate portions are integrated by welding or the like so that sufficient strength is obtained in all directions.

The torque arm support 31 is a member of which the respective plate portions are formed of a plate material such as rolled steel (for example, SS400) for general structural applications. The torque arm support 31 is a high-rigidity member of which the respective plate portions are integrated by welding or the like so that sufficient strength is obtained in all directions. Moreover, the torque arm support 31 and the torque arm member 32 are formed bilaterally symmetrical in a side view as illustrated in FIG. 2. Further, the torque arm support 31 and the torque arm member 32 are formed bilaterally symmetrical in a plane orthogonal to the axis of the rotation driving shaft 12. Thus, it is possible to prevent the motor body 22 from rotating about the axis of the rotation driving shaft 12 whether the rotation shaft portion 21 of the hydraulic pressure motor 20 rotates in a normal rotation direction or a reverse direction. The torque arm 30 is fixed to the body frame 2*a* at a position corresponding to a radius larger than the radius of the flywheel 13 so as to stop the rotation of the motor body 22 of the hydraulic pressure motor 20 reliably. Since rotation of the motor body 22 is stopped reliably, the driving force of a large torque can be transmitted on the rotation shaft portion 21 side of the hydraulic pressure motor 20. The torque arm 30 includes the torque arm support 31 and the torque arm member 32.

The crushing operation that the jaw crusher 2 performs by allowing the rotation driving shaft 12 to be rotated by the hydraulic pressure motor driving portion 3 will be described. A pressure fluid is supplied to the hydraulic pressure motor 20 of the hydraulic pressure motor driving portion 3 to rotate the hydraulic pressure motor 20. When the hydraulic pressure motor 20 rotates, the rotation driving shaft 12 rotates also and the eccentric shaft portion of the rotation driving shaft 12 allows the swing jaw 8 provided so as to face the fixed tooth 4 to perform a swing operation. When the swing jaw 8 swings, the movable tooth 5 moves closer to and away from the fixed tooth 4 whereby the operation of crushing raw materials is performed. Raw materials input from an inlet port of the crushing chamber 6 are crushed inside the crushing chamber 6 and the materials crushed to predetermined sizes fall from a discharge port of the crushing chamber 6.

In this case, the rotation shaft portion 21 of the hydraulic pressure motor 20 is strongly connected and fixed to the end surface of the flywheel 13 by the connector 40. As described above, since the hydraulic pressure motor 20 and the flywheel 13 are connected by the connector 40 in a state of being fixed by the bolt 44, the bolt 45, the fastening bolt 43, and the like at a position with a pitch circle (D) diameter larger than the diameter of the rotation driving shaft 12, a large torque can be transmitted. The motor body 22 of the hydraulic pressure motor 20 is strongly fixed to the body frame 2*a* with the torque arm 30 interposed and the rotation of the motor body 22 is stopped by the torque arm 30. In other words, the torque arm 30 is fixed to the body frame 2*a* side at a position corresponding to a radius larger than the radius of the flywheel 13, whereby the rotation of the motor body 22 of the hydraulic pressure motor 20 is stopped. Moreover, the engagement convex portion 32*d* formed in the torque arm member 32 engages with the engagement concave portion 31*e* of the torque arm support 31 and the torque arm support 31 and the torque arm member 32 are fastened and fixed together by the bolts 33, the nuts 34, and the like. With such a configuration of the torque arm 30, it is possible to provide an excellent rotation prevention effect. In other words, since the jaw crusher 2 includes the connector 40, the torque arm 30, and the like, a large driving torque can be reliably transmitted from the rotation shaft portion 21 of the hydraulic pressure motor 20 to the flywheel 13 and the rotation driving shaft 12.

The crushing operation that the jaw crusher 2 performs by allowing the rotation driving shaft 12 to be rotated by the electric motor 50 of the electric motor driving portion 7 will be described. When the controller 55 drives the electric motor 50, the driving torque of the electric motor 50 is transmitted to the rotation driving shaft 12 via the belt transmission mechanism (driving force transmission mechanism) made up of the driving pulley 51, the belt 52, the driven pulley groove 14*a*, and the like, whereby the rotation driving shaft 12 rotates. With rotation of the eccentric shaft portion of the rotation driving shaft 12, the movable tooth 5 moves closer to and away from the fixed tooth 4 whereby a crushing operation is performed. Raw materials input from the inlet port of the crushing chamber 6 are crushed inside the crushing chamber 6 and the materials crushed to predetermined sizes fall from the discharge port of the crushing chamber 6.

The hydraulic pressure motor driving portion of the jaw crusher driving device having such a configuration may be provided afterwards to an electric motor-driven jaw crusher. Moreover, the hydraulic pressure motor driving portion of the jaw crusher driving device is detachable from the flywheel of the jaw crusher and the torque arm support integrally fixed to the body frame, and the detachment operation is performed from the outer side of the jaw crusher. Thus, it is easy to perform maintenance even when troubles occur.

Although the present invention has been described by way of embodiments, it should be noted that the present invention is not necessarily limited to the foregoing embodiments but can be modified in a variety of ways without departing from the object and gist of the present invention. For example, a thread locking adhesive or the like may be applied to a thread coupling portion in which bolt-coupling is realized so that the thread coupling portion is not loosened by the crushing operation. Moreover, the jaw crusher may be a self-propelled jaw crusher. Further, the torque arm may have a configuration in which an engagement concave portion is provided in the torque arm member and an engagement convex portion is provided in the torque arm support.

What is claimed is:

1. A driving device for a jaw crusher comprising:

a fixed tooth provided in a body frame of the jaw crusher;

a movable tooth provided so as to swing in relation to the fixed tooth;

a rotary driving shaft which is rotatably supported on a pair of bearing portions provided on the end sides of the body frame respectively and in which an eccentric shaft portion for allowing the movable tooth to perform a swing motion is formed, a pair of flywheels fixed to the rotary driving shaft at both ends thereof and protruding out of the pair of bearing portions respectively, so as to increase inertial force of the rotary driving shaft, a hydraulic pressure motor in which a rotary shaft portion can be rotated in relation to a motor body when pressure fluid is supplied;

a connector provided between the rotary shaft portion of the hydraulic pressure motor and a first flywheel of the pair of flywheels positioned outside of the body frame, so as to connect the first flywheel and the rotary shaft portion of the hydraulic pressure motor, and a torque arm provided between the body frame and the motor body of the hydraulic pressure motor, so as to prevent the motor body from being rotated about an axis of the rotary driving shaft when the rotary shaft portion of the hydraulic pressure motor is rotated;

wherein the torque arm is formed of:

a torque arm support provided in a position below the first flywheel and on a side surface of the body frame so as to protrude therefrom in a direction parallel to the axial direction of the rotary driving shaft, and a torque arm member, one end of which is fixed to the torque arm support and the other end of which is fixed to the motor body of the hydraulic pressure motor, the torque arm member preventing the motor body from being rotated about the axis of the rotary driving shaft.

2. The driving device for a jaw crusher according to claim 1, wherein the connector includes a first connection member detachably fixed to an end surface of the flywheel, and a second connection member detachably fixed to an end surface of the rotation shaft portion of the hydraulic pressure motor, the first connection member and the second connection member being fastened and fixed together by a fastening member.

3. The driving device for a jaw crusher according to claim 2, wherein the flywheel other than the first flywheel of the pair of the flywheels receives rotation driving force of an electric motor provided in the body frame via a driving force transmission mechanism.

4. The driving device for a jaw crusher according to claim 1, wherein the torque arm member has a portion on the one end, which is detachably fixed to the torque arm support.

5. The driving device for a jaw crusher according to claim 4, wherein the torque arm member has a portion on the other end, which is formed in a ring shape so as to provide a pipe and a joint for supplying the pressure fluid to the hydraulic pressure motor.

6. The driving device for a jaw crusher according to claim 5, wherein the flywheel other than the first flywheel of the pair of the flywheels receives rotation driving force of an electric motor provided in the body frame via a driving force transmission mechanism.

7. The driving device for a jaw crusher according to claim 4, wherein the torque arm member and the torque arm support are formed in a bilaterally symmetrical shape in a plane orthogonal to the axis of the rotary driving shaft.

8. The driving device for a jaw crusher according to claim 7, wherein the flywheel other than the first flywheel of the pair of the flywheels receives rotation driving force of an electric motor provided in the body frame via a driving force transmission mechanism.

9. The driving device for a jaw crusher according to claim 4, wherein the flywheel other than the first flywheel of the pair of the flywheels receives rotation driving force of an electric motor provided in the body frame via a driving force transmission mechanism.

10. The driving device for a jaw crusher according to claim 1, wherein the flywheel other than the first flywheel of the pair of the flywheels receives rotation driving force of an electric motor provided in the body frame via a driving force transmission mechanism.

11. The driving device for a jaw crusher according to claim 10, wherein the electric motor is used during a normal operation mode and the hydraulic pressure motor is used during start-up or for eliminating troubles.

* * * * *